US005261658A

United States Patent [19]

Nagai

[11] Patent Number: 5,261,658

[45] Date of Patent: Nov. 16, 1993

[54] BEARING AND MECHANISM FOR ROTATIVE SUPPORT OF ROTATING MEMBER

[75] Inventor: Hiroyuki Nagai, Toyonaka, Japan

[73] Assignee: Mita Industrial Co., Ltd., Osaka, Japan

[21] Appl. No.: 714,603

[22] Filed: Jun. 13, 1991

[30] Foreign Application Priority Data

Jul. 9, 1990 [JP] Japan ..... 2-182224

[51] Int. Cl.[5] ..... B65H 39/10

[52] U.S. Cl. ..... 271/297; 271/303; 271/305; 384/215; 384/220; 384/428; 384/439

[58] Field of Search ..... 271/297, 305, 287, 300, 271/303; 384/215, 217, 220, 275, 428, 439, 445

[56] References Cited

U.S. PATENT DOCUMENTS 3,937,459 2/1976 Lawrence ..... 271/297

4,691,914 9/1987 Lawrence ..... 271/297

4,998,716 3/1991 Okumura et al. ..... 271/297

*Primary Examiner*—David H. Bollinger

*Attorney, Agent, or Firm*—Beveridge, DeGrandi, Weilacher & Young

[57] ABSTRACT

A rotator mechanism has a frame, a rotating member and a bearing. The rotating member has a center rod and is rotatable along its axis. The bearing has a bearing portion for supporting the center rod, and a clasping portion for elastically clasping onto the frame. In assembly, first the center rod of the rotating member is positioned into the bearing portion of the bearing. Then, the clasping portion of the bearing is made to elastically clasp onto the frame, whereby the bearing is firmly attached to the frame. In disassembly, the rotating member is easily removed from the frame by detaching the clasping portion from the frame. The rotator mechanism can be applied in a sorter of an image forming apparatus.

18 Claims, 6 Drawing Sheets

BEARING AND MECHANISM FOR ROTATIVE SUPPORT OF ROTATING MEMBER

BACKGROUND OF THE INVENTION

The present invention relates to a bearing in an associated mechanism. More specifically, it relates to a bearing and a mechanism which is located in a frame for rotative support of a rotating member.

An image forming apparatus such as a copying machine includes a plurality of rollers for supplying/discharging sheets of paper. Each of the rollers has an axis the ends of which are rotatively supported in the body of the apparatus. The rollers may be set into a frame in the apparatus by one of the following methods, for example:

(i) By fitting bearings into elliptic holes formed in the frame, and inserting the ends of the center rods of the rollers into the bearings, then affixing E-rings to the ends of the rods. (See Japanese Patent Laying-Open No. 171751/1986); and (ii) By fitting bearings onto the ends of the rods of the rollers, and insert the bearings into slant notches formed in the frame.

In conventional method (i), E-rings must be fit onto each of the ends of the roller rods, whereby joining the rollers into the frame during assembly becomes more complex as the number of the rods increases. Furthermore, when rollers must be replaced during maintenance, these many E-rings must be removed and then reattached afterwards, thereby complicating the maintenance as well.

In conventional method (ii), since the bearings at the ends of the rod are merely set into the notches of the frame, the rod and the roller may easily dislodge from the frame and drop, due to, for example, vibration.

SUMMARY OF THE INVENTION

It is an object of the present invention to provide a bearing in a rotator mechanism which simplifies assembly and maintenance and prevents rotating member slippage.

A rotator mechanism according to an aspect of the present invention has a frame, a rotating member and a bearing. The rotating member has a center rod and is capable of rotating on its axis. The bearing has a bearing portion supporting the center rod, and a clasping portion which elastically clasps onto the frame.

A bearing, according to another aspect of the present invention, is for supporting the center rod of a rotating member and is detachably attached to a frame. It has a center rod bearing portion and a clasping portion which elastically clasps onto the frame.

In assembly, the center rod of the rotating member is first positioned into the bearing portion of the bearing. Then the clasping portion of the bearing is elastically clasped onto the frame, becoming firmly attached. In disassembly, the rotating member is easily removed from the frame by detaching the clasping portion from the frame.

Thus, assembly and disassembly may be performed with ease. Additionally, since the bearing member is elastically clasped onto the frame, slippage of the rotating member is prevented.

These and other objects and advantages of the present invention will be more fully apparent from the following detailed description.

DESCRIPTION OF THE PREFERRED EMBODIMENT

Figure 1:
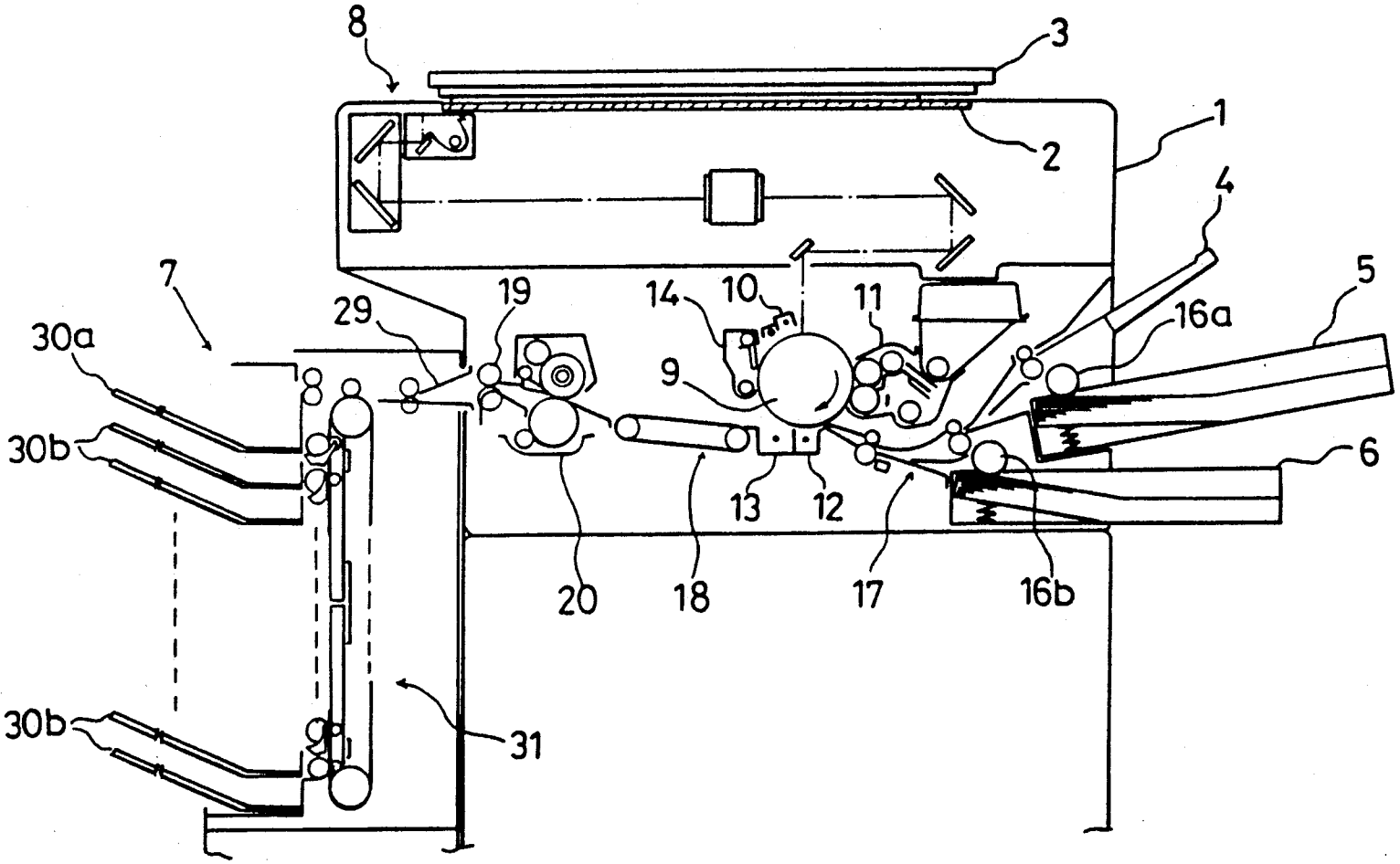
FIG. 1 is a schematic sectional view showing a copying machine including an embodiment according to the present invention.

FIG. 1 shows a copying machine including an embodiment of the present invention.

Referring to FIG. 1, the body 1 of the copying machine has a contact glass 2 in the upper surface, and an original holder 3 which can be opened is disposed on the contact glass 2. On the right side of the body 1 in the figure, a bypass tray 4 and a pair of paper cassette cases 5 and 6 are detachably attached. On the left side of the body 1, a sorter 7 including an embodiment of the present invention is disposed.

In the body 1, an optical exposure system 8 for obtaining information from the original image is located in the upper portion. The exposure system 8 consists of a light source, mirrors and lenses. Disposed in the central part of a lower portion of the body 1 is a photoconductive drum 9 on which an electrostatic image is formed. Surrounding the photoconductive drum 9, there are a main charger 10 for charging the photoconductive drum 9 with a predetermined level of electric charge, a developing unit 11 for developing an electrostatic image, a transfer unit 12 for transferring a toner image to paper, a detach unit 13 for detaching paper from the photoconductive drum 9 , and a cleaning unit 14 for removing toner from the photoconductive drum 9, in that order.

A paper transporting path 17 extends from the bypass tray 4 and the paper cassette cases 5 and 6 to the image forming part which includes the photoconductive drum 9. A paper discharging path 18 is provided in a part of the paper flow stream beyond the image forming part. At the ends of the paper cassette cases 5 and 6 near the paper transporting path 17, feeding rollers **16*a* and 16*b* are provided to feed singly sheets of paper to the paper transporting path 17. A fixing unit 20 for fixing a transferred image onto the fed paper, and discharging rollers 19 for discharging the fixed paper to the sorter 7, are disposed between the paper discharging path 18 and the sorter 7**.

The sorter 7 has a receiving path 29 for receiving paper from the discharging rollers 19, a plurality (for example, eleven) of bins **30*a* and 30*b* in a vertically-gapped arrangement, and a delivering mechanism 31 disposed between the receiving path 29 and the bins 30*a* and 30*b*. The bins 30*a* and 30*b* consist of non-sorting bin 30*a* above and sorting bins 30*b*** below.

Figure 2:
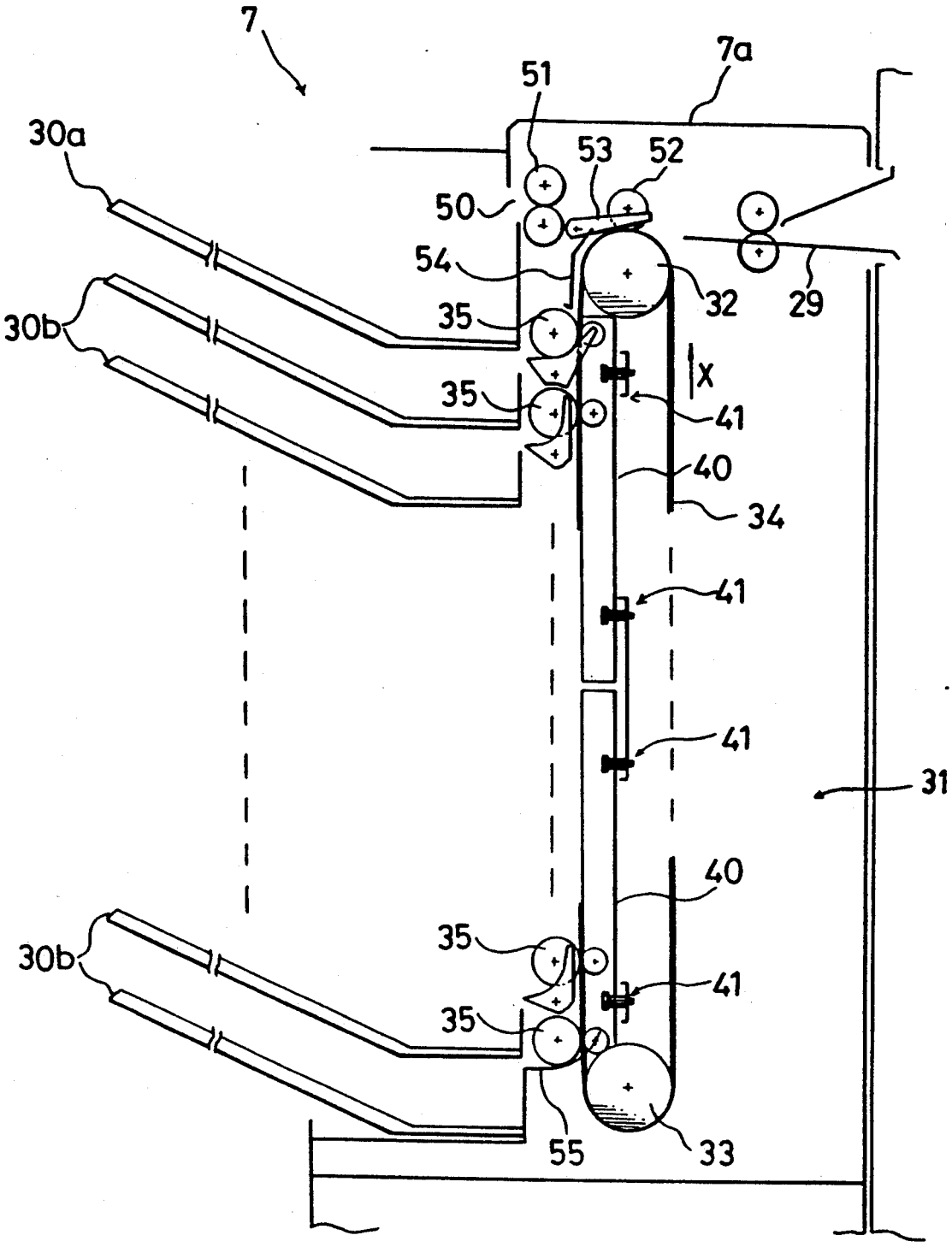
FIG. 2 is a schematic sectional view showing a sorter including an embodiment according to the present invention.

Referring to FIG. 2, the delivering mechanism 31 has a large-type roller 32 in the upper portion and another large-type roller 33 in the lower portion. The lower roller 33 is connected with a driving mechanism (not shown). Guide belts 34 extend around the large-type rollers 32 and 33. A plurality of discharging rollers 35 correspond with the sorting bins 30*b* in the vicinity of the bases of the bins 30*b*. Each discharging roller 35 is pressed onto the outer surface of the guide belts 34 which face the bins 30*b*. The discharging rollers 35 are rotatively supported by a case 7*a* of the sorter 7.

Figure 3:
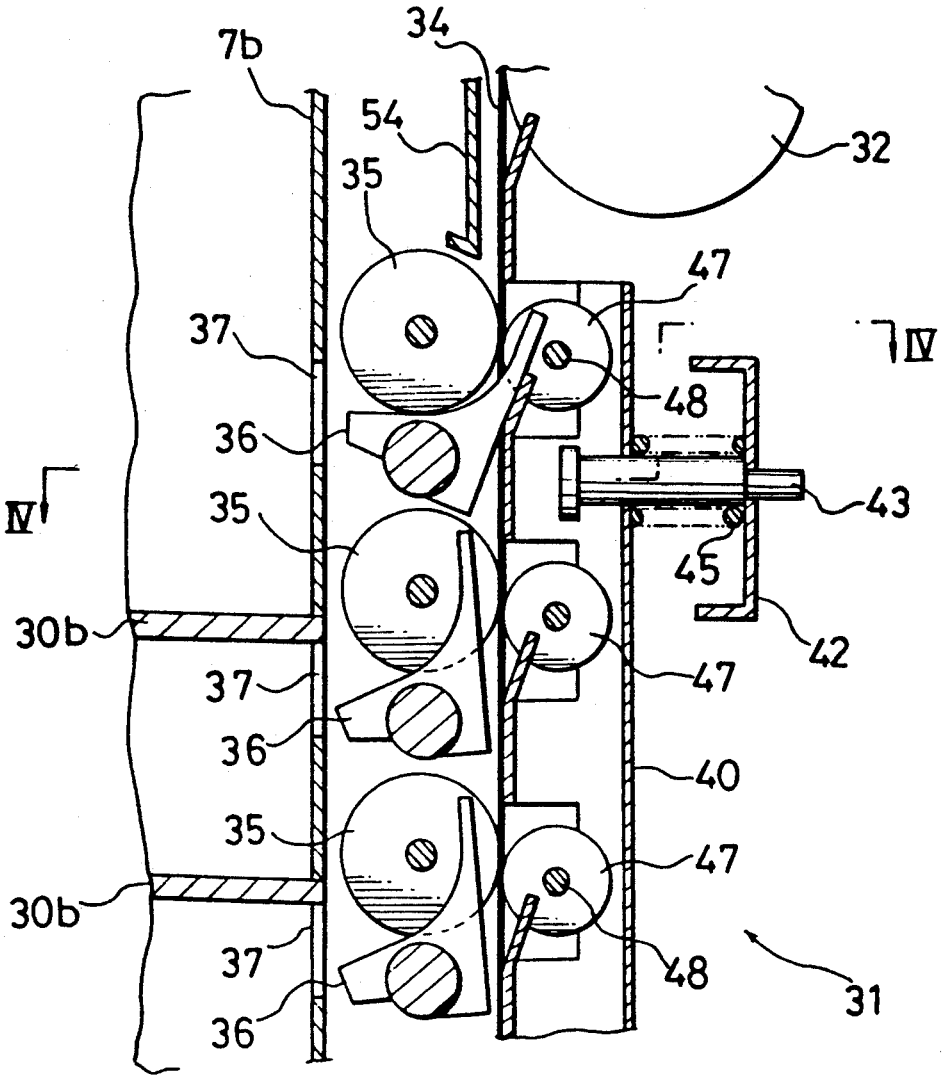
FIG. 3 is an enlarged partial view of the sorter corresponding to a sectional view taken along the line III—III of FIG. 4.

Referring to FIG. 3, sorting claws 36 are provided under the discharging rollers 35. Each sorting claw 36 is connected to a solenoid mechanism (not shown) which is operable independently of the others, whereby the sorting claw 36 is shifted between the sorting position, as shown at the top in FIG. 3 and the non-sorting position, as shown at the bottom. Furthermore, a wall 7*b* of the sorter 7 has openings 37 to allow a sheet of paper to pass through from the pairs of the discharging rollers 35 and the sorting claws 36 to the bins 30*b*.

Referring to FIG. 2, an opening 50 to allow paper to pass through is provided above the base of the non-sorting bin 30*a*, and a pair of discharging rollers 51 are provided before the opening 50. Located between the rollers 51 and the receiving path 29 is a pressing roller 52, which presses onto the large-type roller 32 through the guide belts 34, and a switching claw 53 for changing the direction of paper transfer. The switching claw 53 is connected with a solenoid mechanism (not shown) whereby the claw 53 is shifted between one transferring position, for transferring paper toward the sorting bins 30*b*, and another transferring position (not shown), for transferring paper toward the non-sorting bin 30*a*. Provided under the switching claw 53 is a guide plate 54 extending toward the uppermost discharging roller 35 along the guide belts 34 at a specific gap. The lowermost discharging roller 35 has no corresponding sorting claw; rather, it has a fixed guide plate 55.

The portion of the delivering mechanism 31 in which the present invention is applied will be described in detail.

Figure 4:
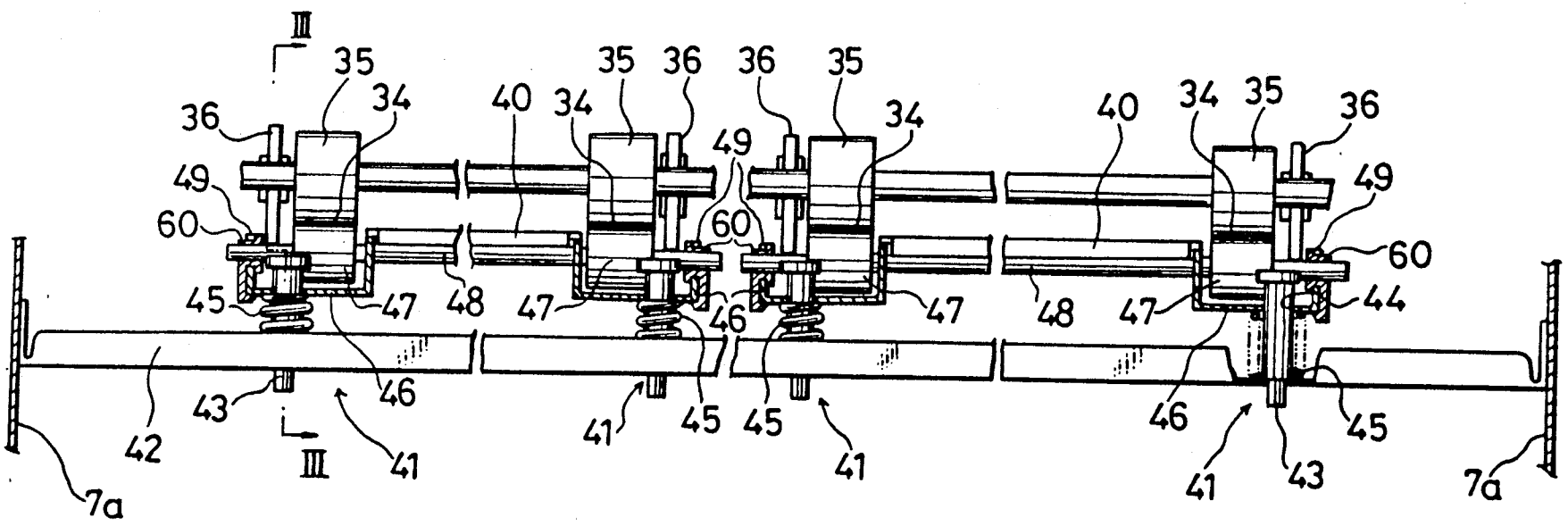
FIG. 4 is a sectional view taken along the line IV—IV of FIG. 3.

Four guide holders 40 are disposed inside the guide belts 34 of which one couple is aligned vertically, as shown in FIG. 2, and of which the second couple is aligned horizontally, as shown in FIG. 4. The guide holders 40 are made of metal plates. Against the back side (or right side in FIG. 2) of each guide holder 40 are pressing mechanisms 41. The pressing mechanisms 41 are disposed at the four corners of each guide holder 41. As shown in FIG. 4, the pressing mechanisms 41 are connected to stays 42 which extend horizontally and are fixed at their ends to the case 7*a*. Each of the pressing mechanisms 41 has a stud pin 43 one end of which is fixed into the stay 42, standing it on the stay 42 at a right angle extending horizontally. The stud pin 43 has a head at the other end. The middle portion of the stud pin 43 is slidably inserted into a hole 44 formed in a side portion of the guide holder 40. Coil springs 45 are fitted onto the stud pins 43 in compression between the guide holders 40 and the stays 42. The coil springs 45 push the guide holders 40 toward the discharging rollers 35. The guide holders 40 include roller housings 46 having holes 44 in either end. The roller housings 46 contain guide rollers 47 which face against the discharging rollers 35 through the guide belts 34.

Each pair of the guide rollers 47 has a center rod 48; and at the ends of the rod 48, bearings 60 according to the present invention are provided. The bearings 60 are made of polyacetal resin, and, as shown in FIGS. 5 and 6, consist of a bearing portion 61 rotatively supporting the center rod 48, and a clasping portion 62 integral with the bearing portion 61.

The bearing portion 61 has a hole 61*a* into which the center rod 48 is inserted. The bearing portion 61 is fitted into a U-shaped notch 49 formed in the roller housing 46. The bearing portion 61 includes a pair of flat surfaces 61*b* in parallel on its circumferential rim, and the flat surfaces 61*b* contact a pair of inner flat surfaces of the notch 49. Additionally, the bearing portion 61 has a flange portion 63 which contacts the inner surface (or the posterior surface in FIGS. 5 and 6) of lateral wall 46*a* of the roller housing 46. As shown in FIG. 6, the flange portion 63 extends radially from both of the flat surfaces 61*b*.

The clasping portion 62 extends from the bearing portion 61 along the lateral wall 46*a*. The clasping portion 62 has, at its end, a turned portion 62*a* at approximately a right angle. At the tip of the turned portion 62*a*, a bevel surface 62*c* is provided in order to ease the operation of engaging the bearing 60. Furthermore, the roller housing 46 has an opening 64 extending from the lateral wall 46*a* to the base wall 46*b*, in the region beyond the notch 49. The turned portion 62*a* clasps onto a tab 65 of a catch portion in the opening 64. As a result, the bearing 60 nips the lateral wall 46*a* by means of the flange 63 and the clasping portion 62, whereby the bearing 60 is fixed into the notch 49 properly. In order to facilitate the operation of detaching the bearing 60, the tab 65 projects slightly from the surface of the base wall 46*b*.

Figure 5:
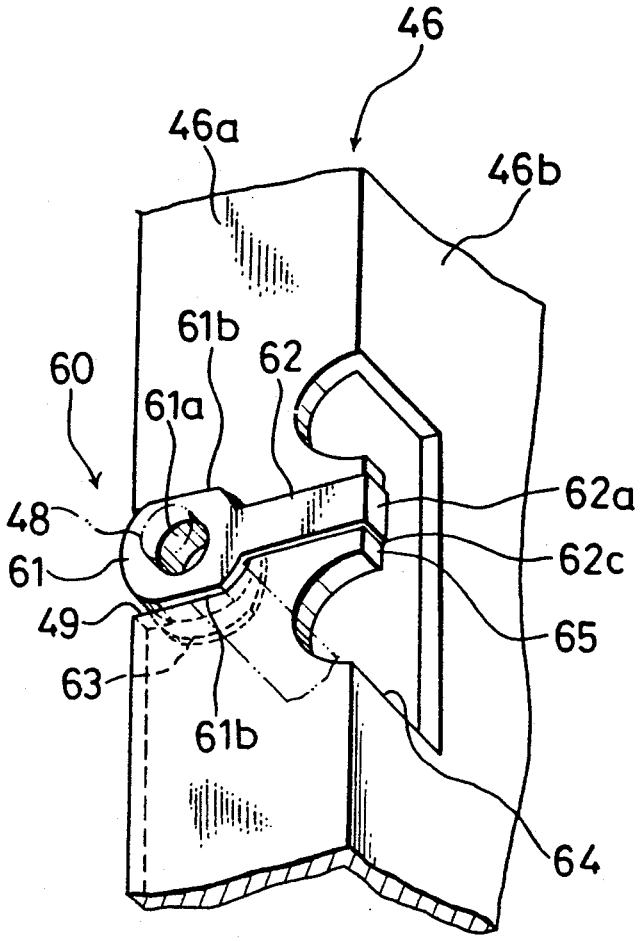
FIG. 5 is an enlarged partial isometric view of an embodiment of the present invention.
Figure 6:
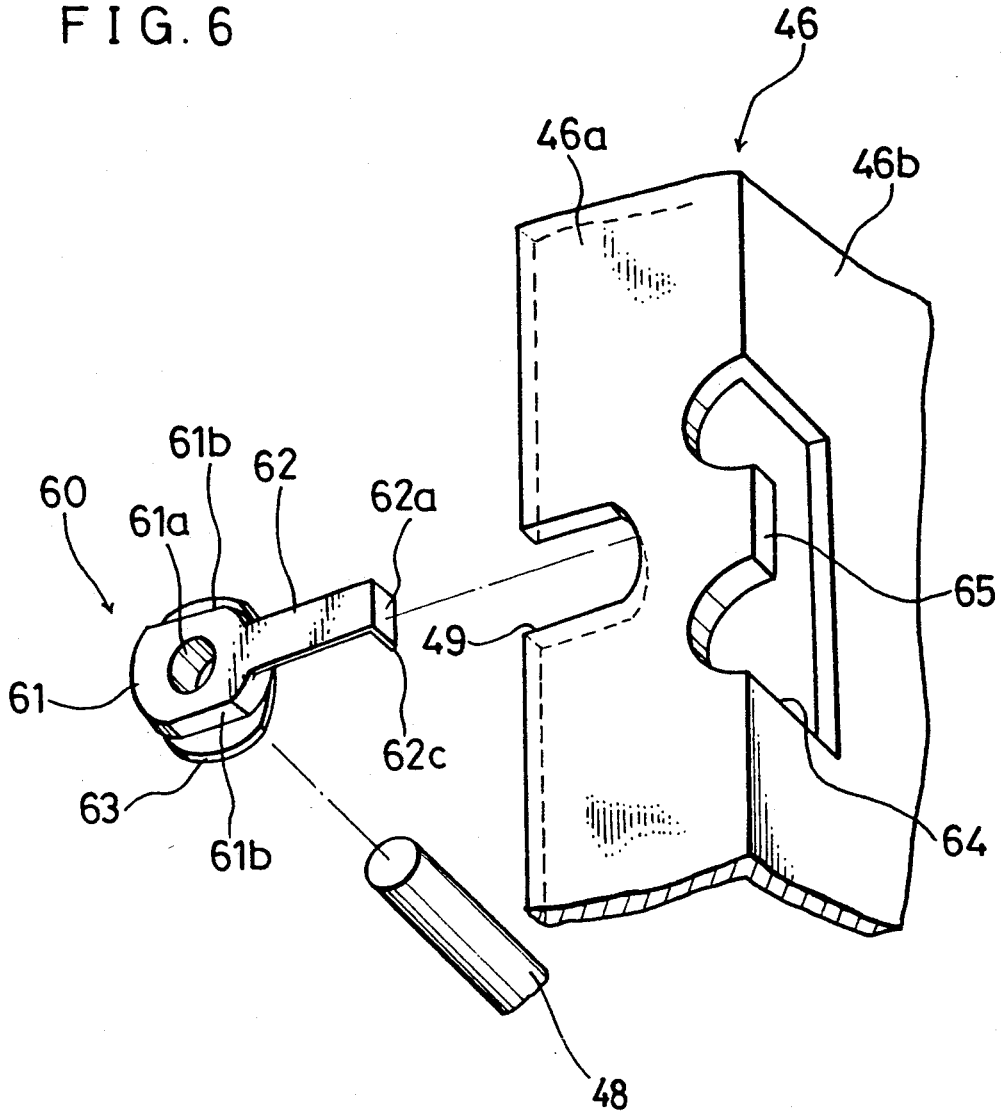
FIG. 6 is an exploded perspective view of the portion shown in FIG. 5.

When the center rod 48 and the bearing 60 as shown disassembled in FIG. 6 are to be assembled into the guide holder 40 as shown in FIG. 5, first the center rod 48 is inserted into the hole 61*a* of the bearing 60. Then, the bearing portion 61 of the bearing 60 is fitted into the notch 49 of the roller housing 46. At the same time, the turned portion 62*a* of the clasping portion 62 is elastically bent and then is clasped onto the projected tab 65 of the roller housing 46, whereby the rod 48 and the roller 47 are properly set.

Thus, the assembly operation is made simpler because the rod 48 and the roller 47 may, without a conventional E-ring, be easily set. Furthermore, since the bearing 60 elastically clasps onto the roller housing 46 by means of its clasping portion 62, the bearing 60 is tenaciously attached, without being susceptible to dislocation due to vibration. When the rod 48 and the roller 47 are disassembled in maintenance, the disassembling can be carried out easily by removing the turned portion 62*a* from the projected tab 65 with a finger. The opening 64 is formed, and the projected tab 65 projects beyond the base wall 46*b*, such that it is easy to hook the turned portion 62*a* with a finger in the disassembling operation.

Since the copying operation of the above described copying machine is not out of the ordinary, the operation is briefly described in the following, in lieu of a detailed description. The position of the switching claw 53 is shifted depending upon whether the set mode is in the non-sorting mode or the sorting mode. When the non-sorting mode is set, sheets of paper are transferred from the receiving path 29 through the discharging rollers 51 and the opening 50 to the bin 30*a*. When the sorting mode is set, sheets of paper are guided by the guide belts 34 and transferred to predetermined bins 30*b* through sorting claws 36 which have been positioned to correlate with the sorting number.

Modifications (a) The present invention can be applied not only to image forming apparatuses, such as copying machines, but also to other apparatuses which include rotating elements.

(b) The present invention is not limited by the above embodiment in which the center rods 48 are rotatively supported by the bearings 61. For example, the rollers 47 may be rotatively supported by the center rods 48, and the center rods 48 may be fixed to the bearings 61.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A rotator mechanism, comprising:

a frame;

a rotating member having a center rod and being capable of rotating on its axis; and a bearing having a bearing portion for supporting said center rod and a clasping portion extending from the bearing portion for elastically clasping the bearing onto said frame.

2. A rotator mechanism according to claim 1, wherein:

said bearing portion includes a pair of plane surfaces in parallel on an outer circumferential surface of the bearing portion, and a flange extending radially from at least one of said plane surfaces; and said frame has a U-shaped notch in which said bearing portion is fitted with said plane surfaces.

3. A rotator mechanism according to claim 2, wherein said flange is wider than said U-shaped notch, and said clasping portion includes a turned portion for nipping said frame, whereby said flange and said clasping portion prevent said bearing from moving in an axial direction of the axis.

4. A rotator mechanism according to claim 3, wherein said clasping portion is located on a outside of said frame.

5. A rotator mechanism according to claim 2, wherein said frame has a catch portion located in a region beyond said U-shaped notch; and said clasping portion includes a turned portion at its end which clasps said catch portion, whereby said bearing is prevented from dislocating from said notch.

6. A rotator mechanism according to claim 5, wherein an end of said turned portion has a bevel surface to ease clasping of the catch portion.

7. A rotator mechanism according to claim 5, wherein said catch portion includes a tab, and said frame has a base wall and an opening, wherein said tab projects beyond said base wall; and said turned portion clasps onto said tab in said catch portion so that said flange and said clasping portion nip said frame.

8. A bearing for supporting a center rod of a rotating member, wherein the bearing is adapted to be detachably attached to a bearing-attaching portion of a frame, comprising:

a bearing portion for supporting a center rod; and a clasping portion extending from the bearing portion for elastically clasping onto a frame.

9. A bearing according to claim 8, wherein said clasping portion attaches to a bearing-attaching portion of the frame, and said bearing portion has a pair of plane surfaces in parallel formed on an outer circumferential surface of said bearing portion, the plane surfaces corresponding to a U-shaped notch in the bearing-attaching portion of the frame, and a flange radially extending from at least one of said plane surfaces.

10. A bearing according to claim 9, wherein said flange extends wider than the U-shaped notch, and said clasping portion includes a turned portion, whereby said flange and said turned portion of said clasping portion are disposed so as to nip the frame.

11. A bearing according to claim 10, wherein said clasping portion is located on an outside of the frame.

12. A bearing according to claim 9, wherein an end of said clasping portion has a turned portion to clasp onto the bearing-attaching portion.

13. A bearing according to claim 12, wherein an end of said turned portion has a bevel surface to ease clasping of said bearing.

14. A bearing according to claim 8, wherein the bearing is made from a polyacetal resin material.

15. A sorter comprising:

a sheet receiving path for receiving sheets;

a plurality of bins in a vertically-gapped alignment; and a delivering mechanism disposed between said sheet receiving path and said bins, including a circulating guide belt, discharging rollers rotatively pressed on an outer surface of said guide belt, sorting claws located under said discharging rollers, guide rollers located inside of said guide belt, and a guide holder located inside of said guide belt and having a frame and bearings, wherein the bearings include a bearing portion for supporting said guide rollers, and a clasping portion extending from said bearing portion for elastically clasping onto said frame.

16. A sorter according to claim 15 further comprising a pressing mechanism for elastically pressing said guide holder against said discharging rollers.

17. A sorter according to claim 15, wherein said frame has roller housings in either side, in which said guide rollers are located.

18. A sorter according to claim 15, wherein said discharging rollers are located near bases of said bins.

* * * * *